US011245178B2

(12) United States Patent
Shen et al.

(10) Patent No.: US 11,245,178 B2
(45) Date of Patent: Feb. 8, 2022

(54) WIFI ANTENNA AND WIRELESS COMMUNICATION DEVICE

(71) Applicant: AAC Technologies Pte. Ltd., Singapore (SG)

(72) Inventors: Yachuan Shen, Shenzhen (CN); Lei Zheng, Shenzhen (CN); Yongsheng Peng, Shenzhen (CN); Hongjun Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,932

(22) Filed: Aug. 19, 2020

(65) Prior Publication Data

US 2020/0411951 A1 Dec. 31, 2020

Related U.S. Application Data

(63) Continuation of application No. PCT/CN2019/094080, filed on Jun. 30, 2019.

(51) Int. Cl.

| | |
|---|---|
| ***H01Q 1/22*** | (2006.01) |
| ***H01Q 5/20*** | (2015.01) |
| ***H01Q 5/307*** | (2015.01) |
| ***H01Q 9/26*** | (2006.01) |

(52) U.S. Cl.

CPC ..... *H01Q 1/2291* (2013.01); *H01Q 5/20* (2015.01); *H01Q 5/307* (2015.01); *H01Q 9/26* (2013.01)

(58) Field of Classification Search

CPC ..... H01Q 1/2291; H01Q 5/20; H01Q 5/307; H01Q 9/26

See application file for complete search history.

(56) References Cited

U.S. PATENT DOCUMENTS

2009/0284432 A1* 11/2009 Cozzolino ..... H01Q 9/42 343/821

FOREIGN PATENT DOCUMENTS

CN 104577308 A * 4/2015

* cited by examiner

*Primary Examiner* — Andrea Lindgren Baltzell
*Assistant Examiner* — Amal Patel
(74) *Attorney, Agent, or Firm* — W&G Law Group

(57) ABSTRACT

A WIFI antenna, including: a dipole including a first radiator and a second radiator that are arranged opposite to and spaced apart from each other; a feeding port provided at adjacent ends of the first radiator and the second radiator; a balun structure including a first access portion, a second access portion provided opposite to the first access portion, and an intermediate portion connecting the first access portion with the second access portion, and the intermediate portion having an annular structure; the first access portion of the balun structure is connected to the first radiator at the feeding port, and the second access portion is connected to the second radiator at the feeding port. Setting of the WIFI antenna provides characteristics of omnidirectional radiation, high gain and high physical stability, which not only improves the gain, but also fully covers the WIFI frequency band.

12 Claims, 6 Drawing Sheets

WIFI ANTENNA AND WIRELESS COMMUNICATION DEVICE

TECHNICAL FIELD

The present invention relates to the field of signal processing and, in particular, to a WIFI antenna and a wireless communication device.

BACKGROUND

With the rapid development of wireless communication technology, wireless communication devices (such as routers) have become an indispensable part in our daily lives now. An antenna, which is configured to emit and receive radio waves in order to transmit and exchange radio data signals, is undoubtedly one of the most important components in the wireless communication devices. Traditional antennas often have problems such as low gain and lack of capacity to fully cover a WIFI frequency band.

Therefore, there is an urgent need to propose an antenna that can fully cover the WIFI frequency band and has high gain.

SUMMARY

In view of the problems of the low gain and the inability to fully cover the WIFI frequency band in the traditional antennas, the present invention provides a WIFI antenna and a wireless communication device that can both increase the gain and fully cover the WIFI frequency band.

A WIFI antenna, including:

a dipole including a first radiator and a second radiator that are opposite to and spaced apart from each other;

a feeding port provided at an end of the first radiator and an end of the second radiator that are adjacent to each other; and a balun structure including a first access portion, a second access portion opposite to the first access portion, and an intermediate portion connecting the first access portion with the second access portion, wherein the intermediate portion has an annular structure, the first access portion of the balun structure is connected to the first radiator at the feeding port, and the second access portion is connected to the second radiator at the feeding port.

As an improvement, the first radiator includes a first branch unit and a second branch unit, and the second radiator includes a third branch unit and a fourth branch unit; and each of the first branch unit, the second branch unit, the third branch unit and the fourth branch unit has an L-shaped structure.

As an improvement, the first branch unit and the third branch unit are arranged in central symmetry or in axial symmetry, and the second branch unit and the fourth branch unit are arranged in axial symmetry.

As an improvement, a total length of the first branch unit is greater than a total length of the second branch unit, and a total length of the third branch unit is greater than a total length of the fourth branch unit; and the first branch unit and the third branch unit form an antenna operating in a frequency band of 2.4 GHz-2.5 GHz, and the second branch unit and the fourth branch unit form an antenna operating in a frequency band of 5.15 GHz-5.85 GHz.

As an improvement, the first access portion and the second access portion of the balun structure are arranged in parallel to each other, and the intermediate portion includes: a first horizontal bar, a second horizontal bar and a first vertical bar, the first horizontal bar and the second horizontal bar are parallel to each other and are located on a same side of the first vertical bar, and one end of the first horizontal bar is perpendicularly connected to one end of the first vertical bar and one end of the second horizontal bar is perpendicularly connected to the other end of the first vertical bar, to form the annular structure; and the other end of the first horizontal bar is perpendicularly connected to the first access portion, and the other end of the second horizontal bar is perpendicularly connected to the second access portion.

As an improvement, a length of the first horizontal bar is greater than a length of the second horizontal bar, and a length of the first access portion is greater than a length of the second access portion.

As an improvement, one end of the first branch unit is perpendicularly connected to one end of the second branch unit, and one end of the third branch unit is perpendicularly connected to one end of the fourth branch unit.

In order to achieve the object above, the present invention further provides a wireless communication device including the WIFI antenna above.

The WIFI antenna above includes: a dipole, the dipole including a first radiator and a second radiator that are opposite to and spaced apart from each other; a feeding port provided at an end of the first radiator and an end of the second radiator that are adjacent to each other; and a balun structure including a first access portion, a second access portion opposite to the first access portion, and an intermediate portion connecting the first access portion with the second access portion, wherein the intermediate portion has an annular structure. Setting of the WIFI antenna provides characteristics of omnidirectional radiation, high gain and high physical stability, which not only improves gain, but also fully covers a WIFI frequency band.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will be described in further detail with reference to the accompanying drawings and embodiments in order to make the objectives, technical solutions, and advantages of the present invention clearer. It should be understood that the specific embodiments described herein are only used to explain the present invention but are not intended to limit the present invention.

Figure 1:
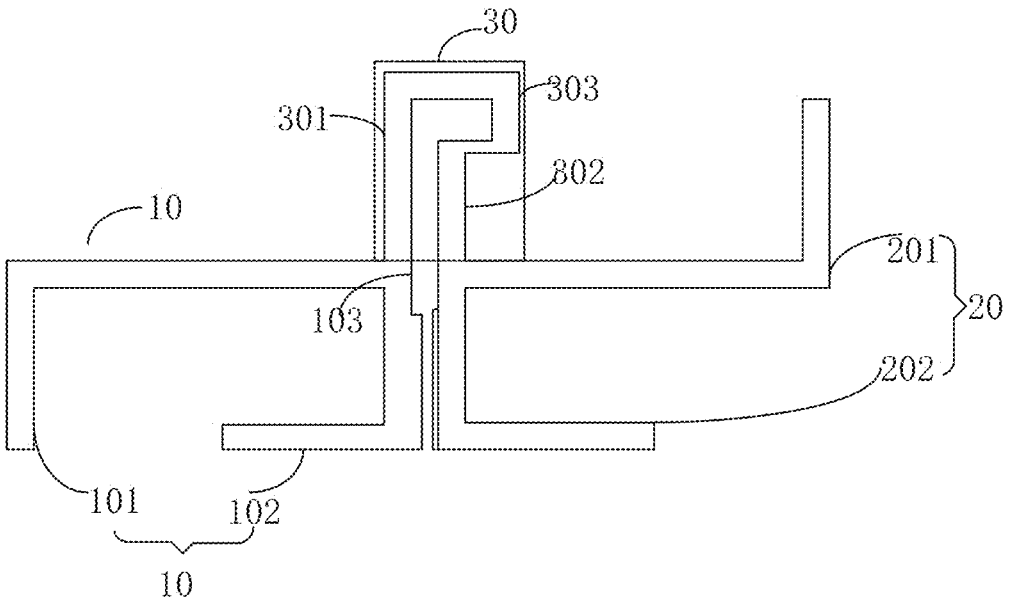
FIG. 1 is a structural diagram of a WIFI antenna in accordance with an embodiment.

As shown in FIG. 1, a WIFI antenna is provided, the antenna includes a dipole, a feeding port 103, and a balun structure 30. The dipole includes a first radiator 10 and a second radiator 20 that are arranged opposite to and spaced apart from each other. The feeding port 103 is provided at adjacent ends of the first radiator and the second radiator. The balun structure 30 includes: a first access portion 301, a second access portion 302 disposed opposite to the first access portion 301, an intermediate portion 303 connecting the first access portion 301 with the second access portion 302, and the intermediate portion 303 has an annular structure. The first access portion 301 of the balun structure is connected to the first radiator 10 at the feeding port, and the second access portion 301 is connected to the second radiator 20 at the feeding port.

The balun refers to a balance-unbalance converter. The antenna composed of the first radiator and the second radiator is a dipole antenna, and the dipole antenna is a balanced antenna according to an antenna principle, while a coaxial cable connected to the antenna is an unbalanced transmission wire. If the dipole antenna is directly connected to the coaxial cable, then a high-frequency current will flow through a sheath of the coaxial cable, affecting radiation of the antenna, so a balun structure needs to be incorporated between the antenna and the ground. The balun structure in the present invention is a balun structure having an annular structure, and through adopting the balun structure, the WIFI antenna has characteristics of high gain, omnidirectional radiation and high physical stability.

In one embodiment, the balun structure is respectively connected to a middle portion of the first radiator and a middle portion of the second radiator. Shapes of the first radiator and the second radiator can be customized according to needs, for example, they can be in a bending shape.

Referring to FIG. 1, in an embodiment, the first radiator 10 includes: a first branch unit 101 and a second branch unit 102; the second radiator 20 includes: a third branch unit 201 and a fourth branch unit 202. Each of the first branch unit 101, the second branch unit 102, the third branch unit 201, and the fourth branch unit 202 has an "L"-shape structure. The first branch unit 101 and the third branch unit 201 are center-symmetrically arranged, and the second branch unit 102 and the fourth branch unit 202 are axis-symmetrically arranged.

In another embodiment, the first branch unit 101 and the third branch unit 201 may also be axis-symmetrically arranged, which can be customized according to actual needs.

Referring to FIG. 1, in an embodiment, a total length of the first branch unit 101 is greater than a total length of the second branch unit 102, and a total length of the third branch unit 201 is greater than a total length of the fourth branch unit 202. The first branch unit 101 and the third branch unit 201 form an antenna operating in a frequency band of 2.4 GHz-2.5 GHz, and the second branch unit 102 and the fourth branch unit 202 form an antenna operating in a frequency band of 5.15 GHz-5.85 GHz.

Moreover, the total length refers to a sum of lengths of a vertical bar and a horizontal bar that constitute the "L"-shape structure of the branch unit. The WIFI frequency band involves two frequency bands, the first branch unit and the third branch unit form an antenna working in a frequency band of 2.4 GHz-2.5 GHz, and the second branch unit and the fourth branch unit form an antenna working in a frequency band of 5.15 GHz-5.85 GHz, thereby realizing omnidirectional radiation of the WIFI antenna.

Figure 2:
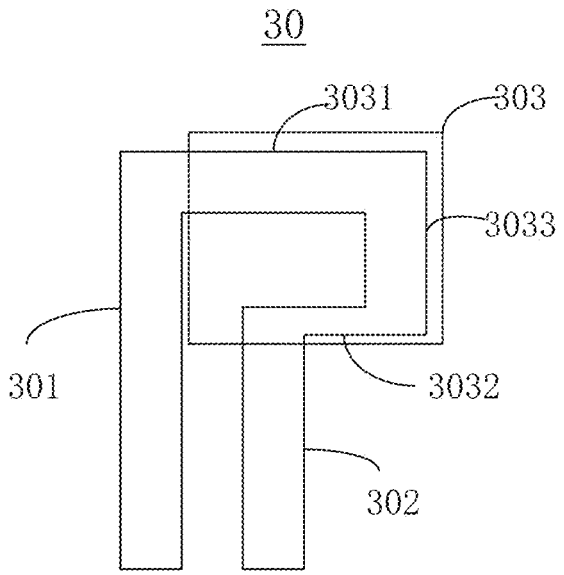
FIG. 2 is a structural diagram of a balun structure in a WIFI antenna in accordance with an embodiment.

As shown in FIG. 2, in an embodiment, the first access portion 301 and the second access portion 302 in the balun structure are arranged in parallel, and the middle portion 303 includes a first horizontal bar 3031, a second horizontal bar 3032 and a first vertical bar 3033. The first horizontal bar 3031 and the second horizontal bar 3032 are parallel to each other and located on the same side of the first vertical bar 3033. One end of the first horizontal bar 3031 is perpendicularly connected to one end of the first vertical bar 3033, and one end of the second horizontal bar 3032 is perpendicularly connected with the other end of the first vertical bar 3033, in order to form an annular structure.

The other end of the first horizontal bar 3031 is perpendicularly connected to the first access portion 301, and the other end of the second horizontal bar 3032 is perpendicularly connected to the second access portion 302.

Referring to FIG. 2, in an embodiment, a length of the first horizontal bar is greater than a length of the second horizontal bar, and a length of the first access portion is greater than a length of the second access portion.

In an embodiment, one end of the first branch unit is perpendicularly connected to one end of the second branch unit, and one end of the third branch unit is perpendicularly connected with one end of the fourth branch unit.

In an embodiment, according to needs of coverage scenarios, multiple WIFI antennas can be combined by different tilt angles, in order to increase a WIFI coverage range in the vertical direction.

Figure 3:
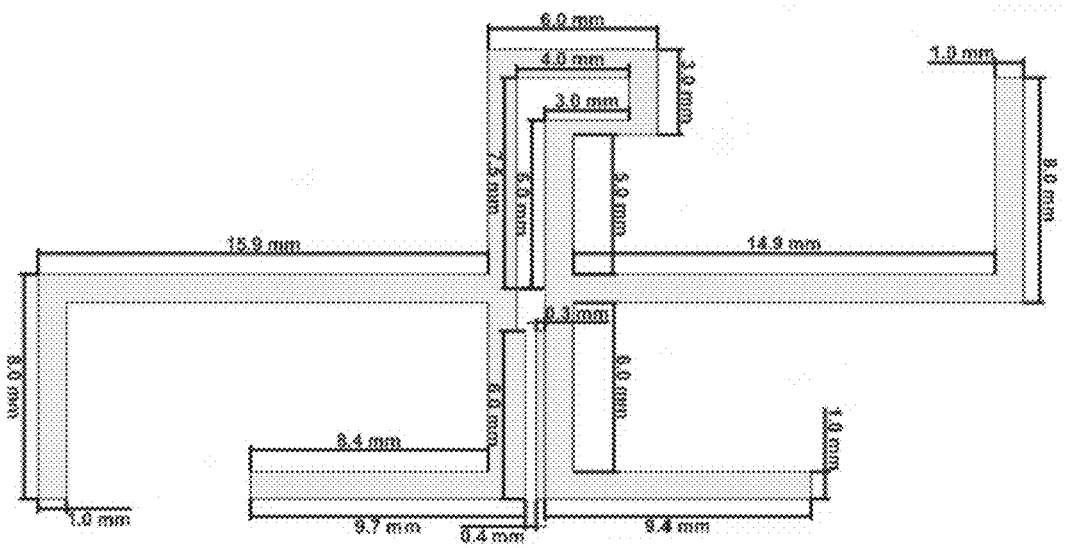
FIG. 3 is a schematic diagram of dimensions of various portions of a WIFI antenna in accordance with an embodiment.

As shown in FIG. 3, in an embodiment, specifically setting of dimensions of respective portions of the WIFI antenna is shown. The total length of the first branch unit is 8 mm+15.9 mm=23.9 mm, a width thereof is 1 mm. The total length of the second branch unit is 9.7 mm+6 mm=15.7 mm. The total length of the third branch unit is 8 mm+14.9 mm=22.9 mm. The total length of the fourth branch unit is 9.4 mm+6 mm=15.4 mm. The length of the first access portion of the balun structure is 7.5 mm, the length of the second access portion is 5 mm, the length of the first horizontal bar in the intermediate portion is 6 mm, the length of the first vertical bar thereof is 3 mm, and the length of the second horizontal bar thereof is 3 mm. Dimensions of other portions are shown in the drawing, and for example, a slot between the first radiator and the second radiator is only 0.4 mm at the lowest bottom. For simulation optimization, a width of a portion in the fourth branch unit is increased by 0.3 mm, and a width of a portion in the second branch unit is increased by 0.3 mm.

Figure 4:
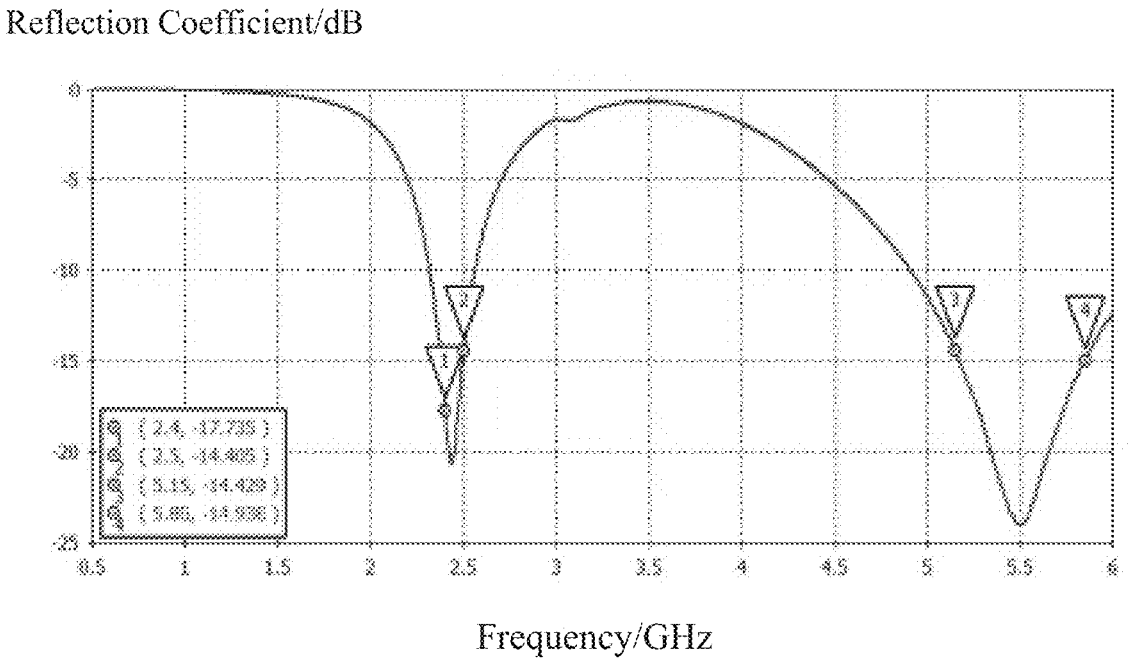
FIG. 4 is a simulation diagram of reflection coefficients corresponding to an WIFI antenna in accordance with an embodiment.
Figure 5:
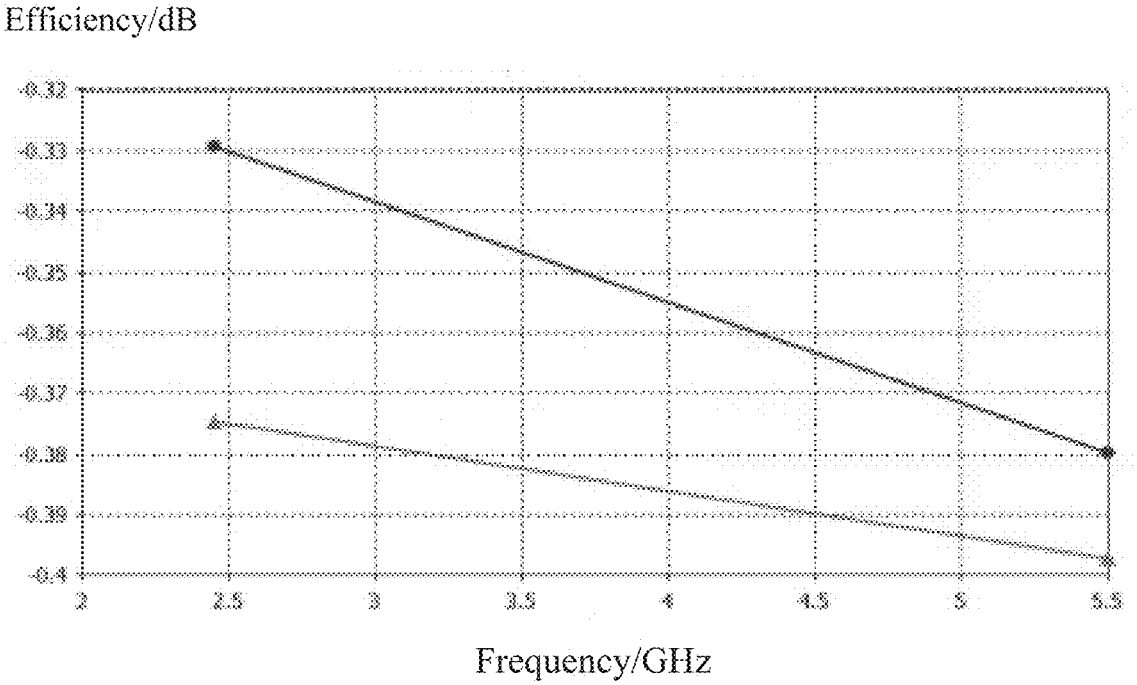
FIG. 5 is a simulation diagram of antenna efficiencies corresponding to an WIFI antenna in accordance with an embodiment.

As shown in FIG. 4, in an embodiment, a schematic diagram of reflection coefficients corresponding to the WIFI antenna is shown;

FIG. 5 is a schematic diagram of antenna efficiencies corresponding to the WIFI antenna, in which an upper line indicates a radiation efficiency, and a lower line indicates a total efficiency.

Figure 6:
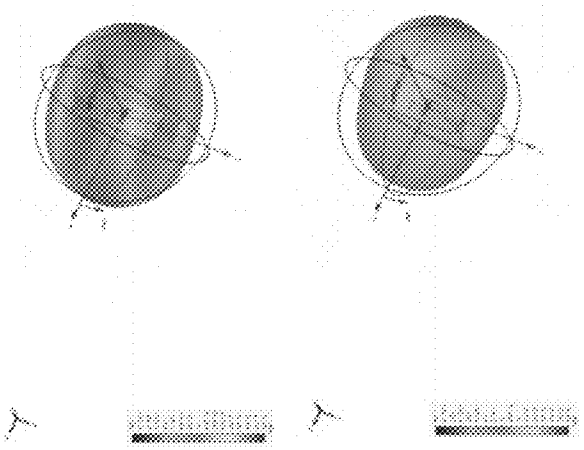
FIG. 6 shows radiation patterns of a WIFI antenna in two different directions in accordance with an embodiment.

As shown in FIG. 6, in an embodiment, radiation patterns of the WIFI antenna in two different directions are shown.

In an embodiment, a wireless communication device is also proposed, and the wireless communication device includes the above-mentioned WIFI antenna.

The various technical features of the above embodiments can be arbitrarily combined. To simplify the description, not all possible combinations of the various technical features in the above embodiments are described, but they should be regarded as falling within the scope of this description as long as there is no contradiction in the combination of these technical features.

The above embodiments only illustrate several implementation manners of the present invention, and the description is relatively specific and detailed, but it should not be understood as a limitation of the patent scope of the present invention. It should be noted that, for those of ordinary skill in the art, a number of modifications and improvements can also be made without departing from the concept of the present invention, and all these fall within the protection scope of the present invention. Therefore, the protection scope of the present invention shall be subject to the appended claims.

What is claimed is:

1. A WIFI antenna, comprising:

a dipole comprising a first radiator and a second radiator that are opposite to and spaced apart from each other;

a feeding port provided at an end of the first radiator and an end of the second radiator that are adjacent to each other; and a balun structure comprising a first access portion, a second access portion opposite to the first access portion, and an intermediate portion connecting the first access portion with the second access portion, wherein the intermediate portion has an annular structure, wherein the first access portion of the balun structure is connected to the first radiator at the feeding port, and the second access portion is connected to the second radiator at the feeding port;

wherein the first radiator comprises a first branch unit and a second branch unit, and the second radiator comprises a third branch unit and a fourth branch unit; and each of the first branch unit, the second branch unit, the third branch unit and the fourth branch unit has an L-shaped structure;

wherein the first branch unit and the third branch unit are arranged in central symmetry about the feeding port, and the second branch unit and the fourth branch unit are arranged in axial symmetry.

2. The WIFI antenna as described in claim 1, wherein a total length of the first branch unit is greater than a total length of the second branch unit, and a total length of the third branch unit is greater than a total length of the fourth branch unit; and the first branch unit and the third branch unit form an antenna operating in a frequency band of 2.4 GHz-2.5 GHz, and the second branch unit and the fourth branch unit form an antenna operating in a frequency band of 5.15 GHz-5.85 GHz.

3. The WIFI antenna as described in 1, wherein the first access portion and the second access portion of the balun structure are arranged in parallel to each other, and the intermediate portion comprises: a first horizontal bar, a second horizontal bar and a first vertical bar, the first horizontal bar and the second horizontal bar are parallel to each other and are located on a same side of the first vertical bar, and one end of the first horizontal bar is perpendicularly connected to one end of the first vertical bar and one end of the second horizontal bar is perpendicularly connected to the other end of the first vertical bar, to form the annular structure; and the other end of the first horizontal bar is perpendicularly connected to the first access portion, and the other end of the second horizontal bar is perpendicularly connected to the second access portion.

4. The WIFI antenna as described in 3, wherein a length of the first horizontal bar is greater than a length of the second horizontal bar, and a length of the first access portion is greater than a length of the second access portion.

5. The WIFI antenna as described in claim 1, wherein one end of the first branch unit is perpendicularly connected to one end of the second branch unit, and one end of the third branch unit is perpendicularly connected to one end of the fourth branch unit.

6. A wireless communication device, comprising the WIFI antenna as described in claim 1.

7. A wireless communication device, comprising the WIFI antenna as described in claim 1.

8. A wireless communication device, comprising the WIFI antenna as described in claim 1.

9. A wireless communication device, comprising the WIFI antenna as described in claim 2.

10. A wireless communication device, comprising the WIFI antenna as described in claim 3.

11. A wireless communication device, comprising the WIFI antenna as described in claim 4.

12. A wireless communication device, comprising the WIFI antenna as described in claim 5.

* * * * *